US006203167B1

(12) United States Patent
Liu et al.

(10) Patent No.: US 6,203,167 B1
(45) Date of Patent: Mar. 20, 2001

(54) DRAWER LIGHT FIXTURE FOR THOSE HAVING VISION DIFFICULTIES

(76) Inventors: Christine Liu; Jonathan Liu; Constance Liu, all of 20397 Via Napoli, Cupertino, CA (US) 95014

( * ) Notice: Subject to any disclaimer, the term of this patent is extended or adjusted under 35 U.S.C. 154(b) by 0 days.

(21) Appl. No.: 09/327,004

(22) Filed: Jun. 7, 1999

(51) Int. Cl.[7] ..... F21V 33/00
(52) U.S. Cl. ..... 362/133; 362/276; 362/802
(58) Field of Search ..... 362/92, 133, 276, 362/802, 155; 340/570

(56) References Cited

U.S. PATENT DOCUMENTS 1,532,935 * 4/1925 Patton ..... 362/133
2,415,055 * 1/1947 Weiskopf ..... 362/133
4,442,478 * 4/1984 Stansbury ..... 362/133
5,758,947 * 6/1998 Glatt ..... 362/105
5,839,816 * 11/1998 Varga et al. ..... 362/153.1

* cited by examiner

*Primary Examiner*—Thomas M. Sember

(57) ABSTRACT

Our invention has to do with an electrical light fixture for brightening the usually dimmer portion of a drawer storage area. Also, this electrical light fixture is small enough to be attached to an inside surface of a desk. When attached, it is preferably located immediately above the storage area of a desk drawer. This invention does not take away the drawer space available for storage. Also, this electrical light fixture uses battery power for providing automatic lighting turn-on when the drawer is opened and for providing automatic turn-off when the drawer is closed. Alternatively, the automatic turn-off occurs after a pre-determined amount of time. This light fixture is especially convenient for those people who have vision difficulties either because of an illness, a surgical operation or just because of age such as being young children or elderly people.

12 Claims, 3 Drawing Sheets

DRAWER LIGHT FIXTURE FOR THOSE HAVING VISION DIFFICULTIES

FIELD OF THE INVENTION

Our invention has to do with an electrical light fixture for brightening the usually dimmer portion of a drawer storage area. Also, this electrical light fixture is small enough to be attached to an inside surface of a desk. More specifically, this invention provides an automatic ON and OFF features using a photo-conductive sensor.

BACKGROUND INFORMATION

Drawers come in different sizes. Desk drawers are usually smaller than the drawers inside a dresser, kitchen cabinet or a closet. In turn, any lighting fixtures designed for cabinets, dressers and closets are generally too bulky for use in the desk drawers. A typical cabinet lighting system in the market today has more than one lamp attached to an inside cabinet wall near a cabinet door. This cabinet lighting fixture also has a transformer and a distribution box. Altogether, the fixture makes it too bulky for use inside a desk drawer. Practically speaking, this lighting fixture can not be easily carried off and be used in another place, and it would be too hard for those who have vision difficulties (e.g., the vision-impaired, young children, and the elderly people) to install and set up.

Although there are light fixtures available in the market today that are specifically designed for illuminating drawers, there are still many disadvantages in using those fixtures. Such a light fixture typically uses a mechanical switch for power turn-on, and it is fixedly attached to a drawer, and therefore, making battery changes difficult. Another such light fixture attaches to the inside surface of the drawer front face, which when the drawer is opened, its emitted lighting often is found to be unnecessary because of the existing room light. As the drawer opens, the attached light fixture also moves away from the back and dimmer portion of the drawer whereby making the light fixture less useful. Furthermore, this light fixture takes up storage space inside the drawer and takes away the space available for storage.

Therefore, one advantage of our invention is to provide a light fixture that does not take away the drawer space available for storage.

Another advantage of the invention is to provide a light fixture whose lighting is directed toward the dimmer portion of the drawer, and in such a manner, whereby enabling better illumination and easier recognition of the items stored toward the back of the drawer.

Yet another advantage of the invention is to provide a light fixture that is easily taken off from the desk for battery changes and that it powers the light bulb ON automatically when the drawer is opened. Furthermore, it provides an automatic light bulb power OFF when the drawer is closed. Alternatively, the light is automatically shut-off after a pre-determined amount of time.

SUMMARY OF THE INVENTION

According to these and other features of our invention, a light fixture is provided for illuminating a drawer for overcoming the disadvantages of the known light fixtures. Briefly, our drawer light fixture has a housing that contains a bulb and battery as its power source. It is removably attached to the inner surface of the desk face that is immediately above the drawer. It further has a photo-conductive sensor that operates as a gating element between the light bulb and the battery. The sensor serves as an ON/OFF switch and is sensitive to the background room light. When triggered by the room light, the sensor would electronically close the switch and turn the light bulb ON. As the drawer closes, the lack of room light would cause the sensor to open the circuit whereby turning the light bulb OFF. Alternatively, a timer circuit electronically coupled to the photo-conductive sensor would turn the bulb OFF after a pre-determined amount of time.

BRIEF DESCRIPTION OF THE DRAWINGS

The above advantages of our invention will no doubt become apparent upon a reading of the following descriptions and a study of the three figures of the drawing.

DETAILED DESCRIPTION OF THE PREFERRED EMBODIMENTS

With today's advances in technology, the battery-powered light fixture designs generally do not require the rendering of fully detailed implementation diagrams. The definition of electronic functionality allows those skilled in the art to design the desired light fixture implementations. Accordingly, functionality will be described in detail with the accompanying drawings. Those of ordinary skill in the art, once given the following descriptions of the various functions to be carried out by the present invention will be able to implement the necessary mechanical and electrical arrangements in suitable technologies without undue experimentation.

Figure 1:
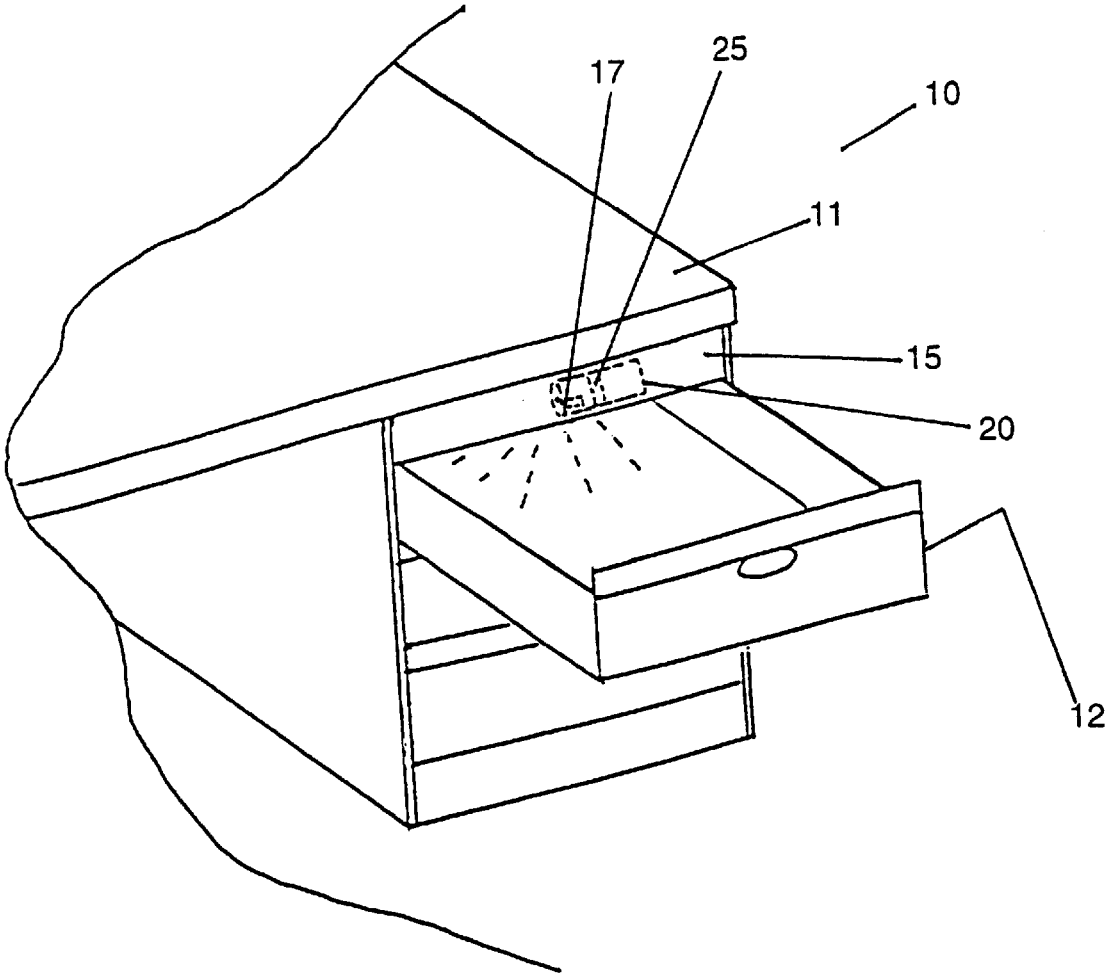
FIG. 1 is a perspective view showing where a preferred embodiment of our invention is placed relative to a drawer.

Referring now to the drawings, FIG. 1 shows a partial view of a desk 10 having a tabletop 11 and a drawer 12. The desk 10 has a separation strip 15 located immediately above the drawer 12 and below the tabletop 11. FIG. 1 also shows an illuminating light fixture 20 embodying the present invention, and it is removably attached to the desk 10. More specifically, the light fixture 20 shown in dash illustrates that it is attached to the inner face of the separation strip 15 of the desk 10. Further, the light fixture 20 has a transparent bulb cover 17 through which light is emitted. The bulb cover 17 may be placed in a position along the inner surface of the separation strip 15 that is convenient for item illumination and recognition. A preferred way for such attachment is through the use of VELCRO 25 or other fastening products in any similar and commercially available manner. In the case of the light fixture 20, VELCRO 25 is wrapped around the light fixture 20 in a generally centrally position. As a result, VELCRO 25 allows the light fixture 20 to be easily taken off of the desk 10 for battery change or easily carried off for use in another location.

The light fixture 20 shown in FIG. 1 has an elongated and generally cylindrical housing, however, engineers who work in this field can easily adapt the shown embodiment with typical engineering efforts into other form factors and configurations, for example, a generally rectangular housing. Preferably, the weight of the housing is to be as light as possible, and the width of the housing is to be as narrow as possible so that light fixture 20 could be easily attached to the back of the separation strip 15 using VELCRO 25.

Figure 2:
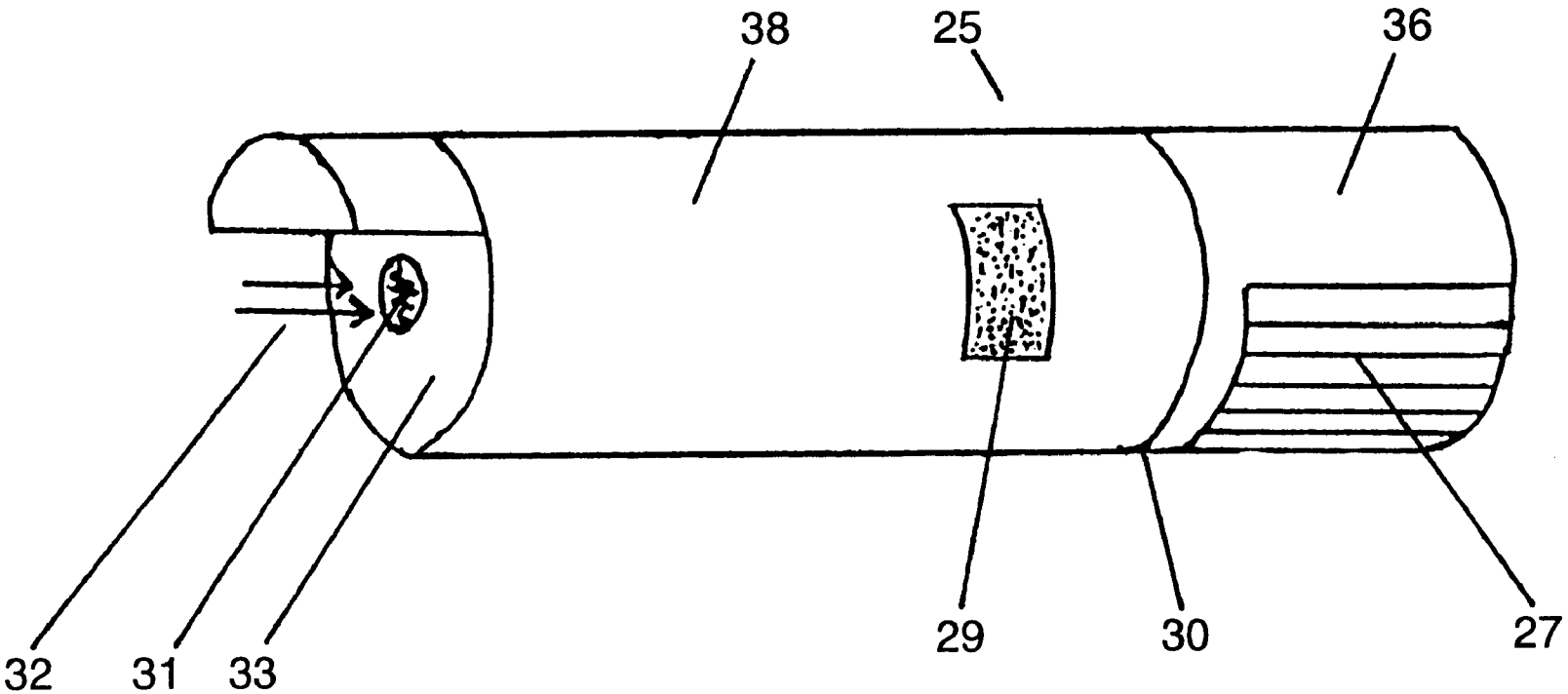
FIG. 2 is a perspective view of another preferred embodiment showing the appearance and features of the present invention.

FIG. 2 illustrates a perspective view of another preferred embodiment of the present invention. Referring now to FIG. 2 in conjunction with FIG. 1, the light fixture 25 also includes an elongated, hollow and generally cylindrical housing 30 formed of plastics or similarly light-weight materials. The fixture 25 further includes a transparent bulb cover 27, a photo-conductor 31 and two VELCRO pieces 29 (one on the other side of the housing 30, and not shown). Although only a portion of the transparent bulb cover 27 is shown, it is readily understood to those skilled in the art that the transparent bulb cover 27 is preferably semi-cylindrical in configuration which covers a portion of an end surface and side surface of the cylindrical housing 30.

The appearance of the light fixture 25 is different from that of the light fixture 20 in that a recess 32 cuts into the generally cylindrical housing 30 at the end opposite to the end where the bulb cover 27 is located. The recess 32 may be up to a substantial portion of that cylindrical end of the housing 30. Also, the VELCRO fabric 29 that is preferably glued to the housing 30 does not wrap around the housing 30. The two patches of the VELCRO fabric 29 allow the light fixture 25 to be easily attached to the separation strip 15 in either direction. Clearly, a receiving VELCRO fabric (not shown) needs to be fastened (e.g., glued) to the inner surface of the separation strip 15 for such an attachment. In this manner, the light fixture 25 can be easily taken off for battery changes or for transport.

The diameter of the cylindrical housing 30 is sufficiently large to allow the housing 30 to receive batteries (not shown), for example, two size A batteries, but it is also sufficiently narrow so that its diameter is shorter than the width of the separation piece 15. The housing 30 has two compartments 36,38, which one compartment 38 contains the batteries and the necessary circuitry including a photo-conductor 31, and the other compartment 36 contains a light bulb (not shown). The photo-conductor 31 is located on a side-facing surface 33 of the recess 32 whereas the photo-conductor of the light fixture 20 although not illustrated in FIG. 1, it is located on the end surface away from view. In FIG. 2, the photo-conductor 31 may also be preferably located on the downward-facing surface of the recess 32.

The light bulb inside the compartment 36 emits light through the transparent bulb cover 27. For clarity purposes, the electrical connections between the bulb, the photo-conductor 31 and the batteries are not shown in FIG. 2; however, only typical engineering efforts are required from the artisans for implementing the electrical connections of the present invention. A general and simple circuit diagram for the present invention is hereinafter described in FIG. 3.

Again referring to FIG. 2, the two housing compartments 36,38 are joined together in a usual threaded manner as in how two compartments of a typical flash light tube are joined together. The bulb cover 27 is preferably made of either a transparent, translucent or any material capable of providing good lighting effects whereas the remaining portion of the compartment 38 and the housing compartment 36 that contains the batteries are preferably made of an opaque plastic material of any color. An aperture is provided on the side-facing surface 33 of the compartment 38, and through which the photo-conductor 31 is securely seated. This photo-conductor 31 in effect acts as an ON/OFF switch to the light bulb.

On the one hand, as the drawer 12 is opened, it allows room light to reach the photo-conductor 31. Even with just a tiny amount of light, the photo-conductor 31 drops in resistance to provide an open channel for the battery power to energize the bulb. The bulb does not need much power to brighten the dimmer and backend portion of the drawer 12. However, the resulting lighting does allow those who have vision difficulties such as young children or the elderly people to better recognize the items located toward the backend portion of the drawer 12 where the room light is typically not bright enough for the vision-impaired. On the other hand, as the drawer 12 is closed, the lack of room light will cause the photo-conductor 31 to act like an open circuit and therefore cutting off the battery power supply to the light bulb.

Figure 3:
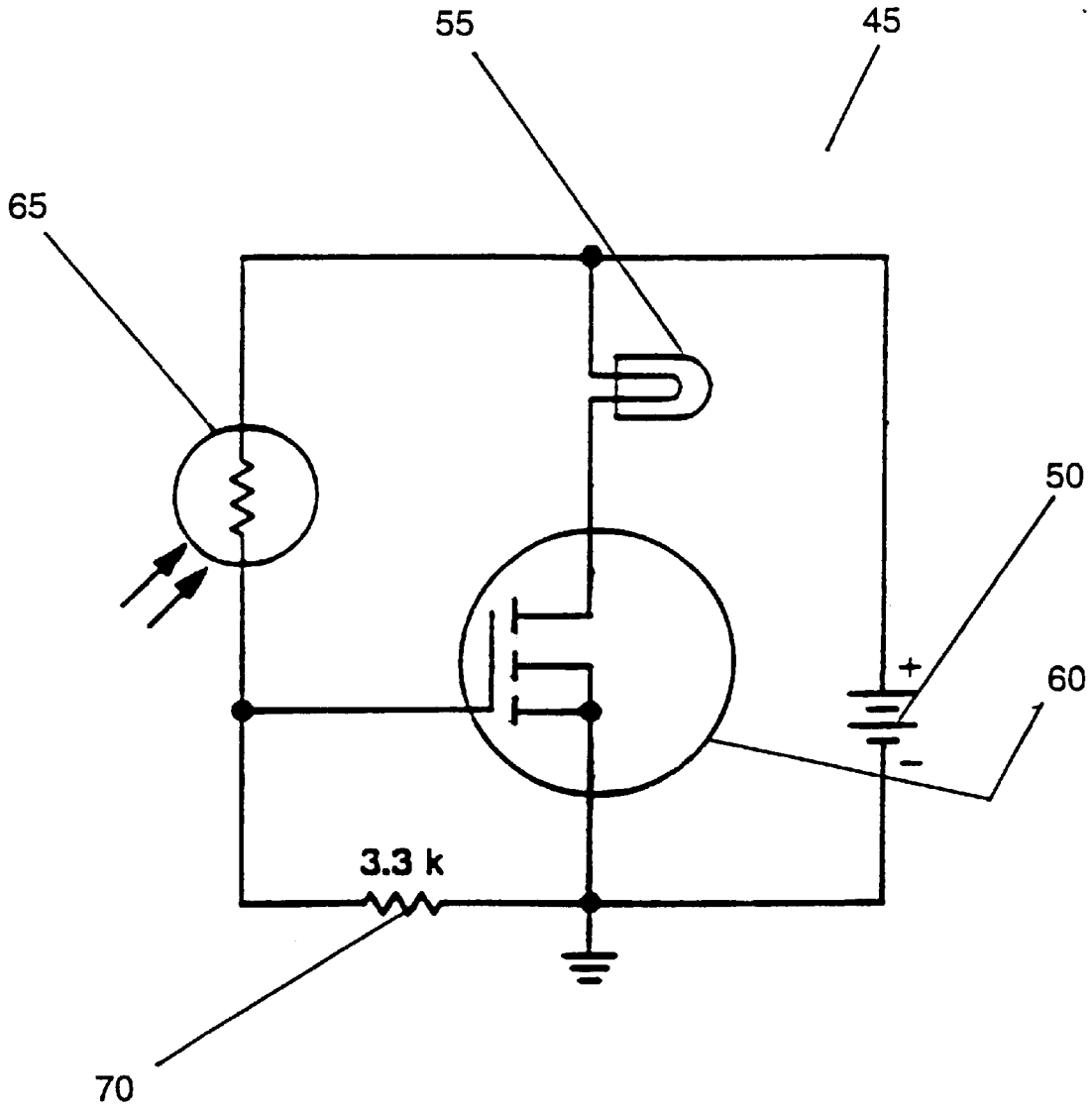
FIG. 3 illustrates a general and simple circuit diagram for the present invention.

FIG. 3 is a general and simple circuit diagram describing the present invention. This general circuit 45 includes a battery 50, a light bulb 55, a transistor 60, a photoconductor 65 and a resistor 70. The bulb 55 is preferably of a low wattage matching the batteries. The transistor is preferably of a low-power FET, for example, the Motorola MTP series FET. The photo-conductor 65 is typically a cadmium sulfide (CdS) photocell. It has a resistance value in the tens of mega-ohms at its high end. However, as the room light reaches the photo-conductor 65, its resistance drops to several hundred ohms. The resistor 70 is preferably of low resistance, for example, 3.3K ohms, as compared to the high resistance value of the photo-conductor 65. When the drawer 12 is closed, very little light falls on the CdS photo-conductor 65. Therefore, its internal resistance is extremely high whereby keeping the transistor 60 OFF and preventing current to pass through the bulb 55. Optionally, a diode may be added across the transistor 60 to further ensure that no current passes through the bulb 55 during the high resistance phase of the CdS photo-conductor 65. When the drawer 12 is opened, the room light hits the CdS photo-conductor 65. Its resistance drops to several hundred ohms whereby turning the transistor 60 ON and allowing the current to pass through the bulb 55.

As a matter of implementation, the components such as the transistor 60 and the resistor 70 are preferably be located close to the photo-conductor 65 inside the housing; however, engineering efforts may result in numerous adequate designs without undue experimentation. Furthermore, with the addition of a few more electronic components including for example, a couple of operational amplifiers and diodes, one can construct a light-controlled one-shot timer circuit found in any typical electronics text. Briefly, the first operational amplifier is configured as a voltage comparator to sense a change in voltage that is applied across the photo-conductor 65, and the other operational amplifier is configured to trigger a one-shot timer by the output of the first operational amplifier. Operationally speaking, as the room light falls on the CdS photo-conductor 65 and causes the voltage that is applied across the photo-conductor 65 to change. The one-shot timer is then triggered and whereby allowing the light bulb 55 to be energized for a pre-determined amount of time such as 60 seconds before the battery power is cut off.

While the present invention has been described in terms of a few preferred embodiments, it is contemplated that persons reading the foregoing detailed description and studying the drawing will realize various alterations and modifications for this invention. It is therefore intended that the following appended claims be interpreted as including all such alterations and modifications as fall within the true spirit and scope of the present invention.

We claim:

1. A drawer light fixture combination wherein a light fixture illuminates a back portion of a drawer without taking up drawer storage space, the drawer light fixture combination comprising:

a desk having a drawer and the desk further having a separation strip located immediately above the drawer;

a first VELCRO fabric fixedly fastened to an inner face of the separation strip;

a generally cylindrical housing having a second VELCRO fabric fastened thereto for attaching said housing to the separation strip by coupling the second Velcro fabric with the first Velcro fabric, said generally cylindrical housing further including a first and a second compartments wherein the first compartment containing a bulb, a semi-cylindrical bulb cover and wherein the second compartment containing two batteries, a photo-conductor, a resistor and a transistor;

the semi-cylindrical bulb cover forming as a part of the first compartment and further being made for allowing light from the bulb to pass through; and the photo-conductor being located on an end surface of the second compartment of the cylindrical housing, the photo-conductor being configured for receiving room light and being further configured electronically with the bulb, the batteries, the resistor and the transistor so that the bulb being automatically energized by the batteries as the drawer is opened and that the power to the bulb being automatically de-energized as the drawer is closed.

2. A light fixture for illuminating a back portion of a drawer without taking up drawer storage space, the drawer light fixture comprising:

a housing including a first and a second compartments wherein the first compartment containing a bulb and a bulb cover and wherein the second compartment containing at least one battery, a photo-conductor and a transistor;

the housing having a means for attaching to an inner face of a separation strip located immediately above a desk drawer;

the bulb cover forming as a part of the first compartment and further being made of a material for allowing light from the bulb to pass through;

the bulb being automatically energized as the desk drawer is opened and so that the bulb being automatically de-energized after a pre-determined amount of time as controlled by a one-shot timer; and the photo-conductor being located on the housing and being configured for receiving room light as the desk drawer is being opened, said photo-conductor being further configured electronically with the bulb, the at least one battery and the transistor so that the bulb being automatically energized and de-energized by the batteries without user intervention.

3. The light fixture as claimed in claim 2 wherein said housing further includes a generally cylindrical housing made of plastics.

4. The light fixture as claimed in claim 2 wherein said attaching means further includes the use of Velcro fabric for ease of removal and transport.

5. The light fixture as claimed in claim 2 wherein said first compartment is configured to have an end surface and a side surface, and wherein the bulb cover further including a configuration forming as a portion of the side surface and at least half of the end surface of the first compartment for allowing light to pass through.

6. The light fixture as claimed in claim 2 wherein said photo-conductor is a cadmium sulfide photocell.

7. The light fixture as claimed in claim 2 wherein the second compartment is configured to have an end surface, and wherein said photo-conductor is located on the end surface of the second compartment for receiving room light.

8. The light fixture as claimed in claim 2 wherein the second compartment is configured to have an end surface and further the second compartment having a recess at its end surface, and wherein said photo-conductor being located on one of the surfaces forming the recess.

9. The light fixture as claimed in claim 2 wherein the photo-conductor in response to a lack of light generating a high resistance value therefore causing the transistor to be OFF and also causing no current to pass through the bulb, the photo-conductor further in response to the room light generating a low resistance value therefore causing the transistor to be ON and also causing current to pass through the bulb.

10. The light fixture as claimed in claim 2 wherein the pre-determined amount of time is approximately 60 seconds.

11. The light fixture as claimed in claim 2 wherein the transistor is a low-power FET.

12. A light fixture for illuminating a back portion of a drawer without taking up drawer storage space, the drawer light fixture comprising:

a cylindrical housing containing a first and a second compartments wherein the first compartment having a side surface and an end surface and further containing a bulb and a bulb cover, said bulb cover including a semi-cylindrical configuration covering a portion of the side surface and the end surface of the first compartment and further forming as a part of the first compartment and further being made of a material for allowing light from the bulb to pass through, and wherein the second compartment having an end surface and including at least one battery, a photo-conductor and a transistor, said second compartment further having a recess at its end surface, said recess having a downward-facing surface;

the cylindrical housing using VELCRO fabric for attaching to an inner face of a separation strip located immediately above a desk drawer;

the photo-conductor being a cadmium sulfide photocell and being located on downward-facing surface of the recess, the photo-conductor being configured for receiving room light as the desk drawer is being opened, said photo-conductor being further configured electronically with the bulb, the at least one battery and the transistor so that the bulb being automatically energized as the desk drawer is opened and automatically de-energized as the desk drawer is closed.

* * * * *